US005101577A

United States Patent [19]

Wedel

[11] Patent Number: 5,101,577

[45] Date of Patent: Apr. 7, 1992

[54] WEB TRANSFER APPARATUS

[75] Inventor: Gregory L. Wedel, Beloit, Wis.

[73] Assignee: Beloit Corporation, Beloit, Wis.

[21] Appl. No.: 431,961

[22] Filed: Nov. 3, 1989

Related U.S. Application Data

[63] Continuation-in-part of Ser. No. 14,569, Feb. 13, 1987, Pat. No. 4,934,067.

[51] Int. Cl.[5] ..... F26B 11/02

[52] U.S. Cl. ..... 34/114; 34/117; 34/115

[58] Field of Search ..... 34/116, 117, 114, 120, 34/115

[56] References Cited

U.S. PATENT DOCUMENTS

| | | | |
|---|---|---|---|
| 3,250,019 | 5/1966 | Beachler | 34/117 |
| 3,868,780 | 3/1975 | Soininen et al. | 34/116 |
| 3,874,997 | 4/1975 | Kanakaanpaa | 34/116 X |
| 4,744,156 | 5/1988 | Futcher | 34/117 X |

FOREIGN PATENT DOCUMENTS

| | | |
|---|---|---|
| 0254666 | 1/1988 | European Pat. Off. . |
| 2212209 | 9/1973 | Fed. Rep. of Germany . |
| 8202937 | 9/1982 | World Int. Prop. O. . |
| 8806205 | 8/1988 | World Int. Prop. O. . |
| 8808898 | 11/1988 | World Int. Prop. O. . |
| 9004065 | 4/1990 | World Int. Prop. O. . |

*Primary Examiner*—Henry A. Bennet

*Attorney, Agent, or Firm*—Drik J. Veneman; Raymond W. Campbell; David J. Archer

[57] ABSTRACT

A transfer apparatus is disclosed for transferring a web from an upstream dryer to a downstream dryer of a dryer section. The apparatus includes a first dryer felt which extends around the upstream dryer for supporting the web such that the web is disposed between the first felt and the upstream dryer for drying a first side of the web. The first felt roll is disposed downstream relative to the upstream dryer for guiding the first felt such that the first felt diverges relative to the upstream dryer and extends from the upstream dryer to and around the first felt roll. A second felt roll is disposed between the upstream dryer and the first felt roll such that the web is disposed between the second felt roll and the first felt. A second dryer felt extends around the downstream dryer for supporting the web such that the web is disposed between the second dryer felt and the downstream dryer for drying a second side of the web. The second felt passes around the second felt roll and extends from the second felt roll to and around the downstream dryer such that the first and the second felts define therebetween a web transfer section, the web being sandwiched between the first and the second felts between the second and the first felt rolls. A device is provided for positively transferring the web from the first felt to the second felt when the first felt diverges relative to the second felt.

6 Claims, 5 Drawing Sheets

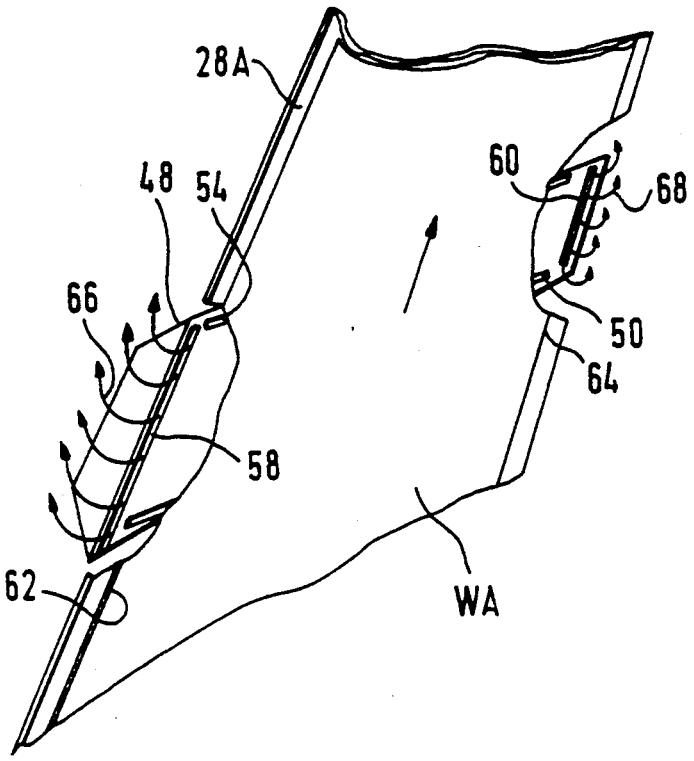
Fig.7
Fig. 8
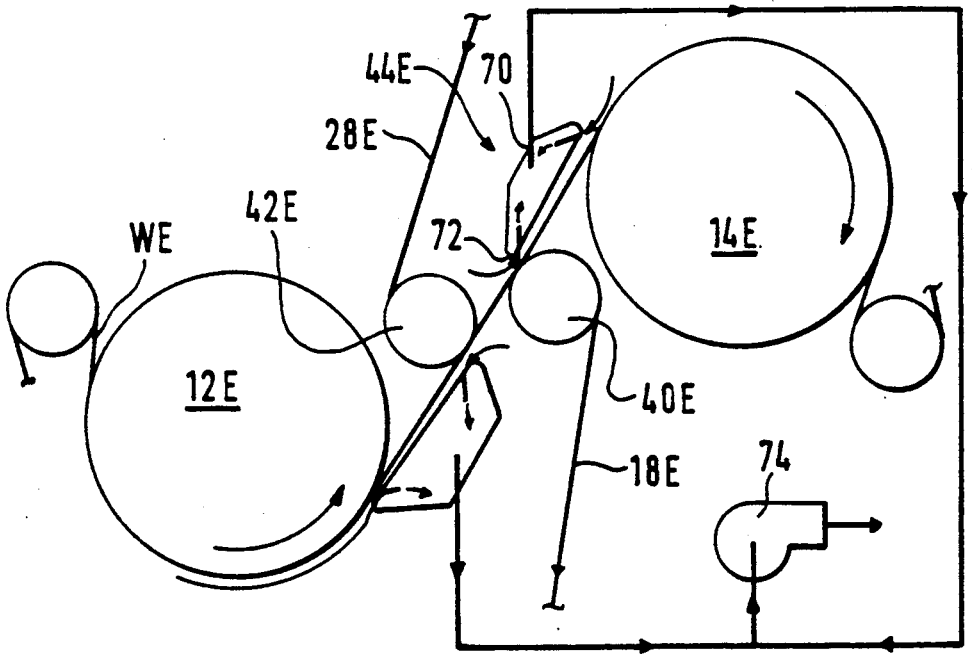

WEB TRANSFER APPARATUS

CROSS-REFERENCE TO RELATED APPLICATION

This application is a continuation in part of co-pending patent application Ser. No. 07/014,569 filed Feb. 13, 1987, now U.S. Pat. No. 4,934,067. All the subject matter of patent application Ser. No. 07/014,569 is incorporated herein by reference.

BACKGROUND OF THE INVENTION

1. Field of the Invention

The present invention relates to a transfer apparatus for transferring a web from an upstream dryer to a downstream dryer of a dryer section. More particularly, the present invention relates to a transfer apparatus for transferring a web without open draw between a first and a second felt of a dryer section.

2. Information Disclosure Statement

Co-pending U.S. patent application Ser. No. 07/014,569 to Beloit Corporation discloses a TOTAL BELRUN dryer section in which a web is guided from a press section to a calender through a dryer section wherein opposite sides of the web are alternately dried as the web moves without open draw between successive tiers of dryers. TOTAL BELRUN is a registered trademark of Beloit Corporation.

In a double felted prior art proposal, a web is dried by passing the web in sinusoidal configuration past a plurality of dryer drums such that a top felt presses the web into close conformity with an upper tier of dryers and a bottom felt presses the web into conformity with the heated external surface of a lower tier of dryers. Of necessity, such a dryer arrangement requires the web to progressively move between the dryers of the respective upper and lower tiers in open draw. Accordingly, movement of the web in such open draws causes edge flutter, curl and cockling of the resultant web.

In order to overcome the problem of edge flutter and the like, the so-called serpentine run dryer section was developed in which the web was supported throughout a dryer section by a single dryer felt moving in sinusoidal configuration around the dryer drums of the upper and lower tiers. Although the serpentine configuration helped to alleviate the problem of edge flutter, a further problem was introduced in that the lower dryer drums became redundant because the dryer felt disposed between the web and the lower dryer drums acted as an insulator and prevented drying of the web during passage around the lower dryer drums.

In the TOTAL BELRUN arrangement of patent application Ser. No. 07/014,569, the web and dryer felt move contiguously around alternately a dryer drum and a vacuum transfer guide roll. The arrangement is such that the web is held in close conformity with the dryer felt during passage of the web around the vacuum transfer roll. Also, the web is sandwiched between the dryer felt and the dryer drum during passage of the web around the dryer for drying thereof. Furthermore, the web is transferred without open draw between successive tiers of dryers so that as the web moves between successive tiers, opposite sides of the web are dried. Accordingly, as the web progresses from the press section to the calender, opposites sides of the web are alternately dried and the web is restrained against cross-machine shrinkage thereof. Therefore, edge flutter, curl and cockling of the web are inhibited.

The present invention is an improvement over the arrangement disclosed in U.S. patent application Ser. No. 07/014,569 and relates particularly to the transfer arrangement between successive tiers. In patent application Ser. No. 07/014,569, an upstream and a downstream vacuum roll guide the respective dryer felts such that the dryer felts define therebetween a web transfer section. However, vacuum transfer rolls are relatively costly, and the present invention seeks to provide a transfer apparatus without open draw of the web using plain transfer rolls in association with adjacent web transfer boxes.

Therefore, it is a primary object of the present invention to provide a transfer apparatus which overcomes the aforementioned disadvantages of the prior arrangement and which provides a significant contribution to the art of drying a web extending through a dryer section.

Another object of the present invention is the provision of a transfer apparatus which includes a first felt roll and a second felt roll disposed between an upstream dryer and the first felt roll such that the web is disposed between the second felt roll and the first felt. A second dryer felt passes around the second felt roll and extends from the second felt roll to and around a downstream dryer such that the first and the second felts defines therebetween a web transfer section, the web being sandwiched between the first and the second felts between the second and the first felt rolls.

Another object of the present invention is the provision of a transfer apparatus which includes means for positively transferring the web from the first to the second felt when the first felt diverges relative to the second felt.

Another object of the present invention is the provision of a transfer apparatus in which a first and second felt roll and an upstream and downstream dryer are disposed relative to each other such that the web between the upstream and downstream dryers follows a common tangent to the dryers and felt rolls.

Another object of the present invention is the provision of a transfer apparatus in which the first and the second felt rolls intersect a common tangent of the upstream and downstream dryers such that the first felt wraps around the second felt roll and the second felt wraps around the first felt roll so that the felts extending between the second and first felts rolls are disposed parallel relative to each other for stabilizing the felts during transit through the transfer section.

Another object of the present invention is the provision of a transfer apparatus in which the felts define therebetween a converging nip such that when the second felt is driven at a higher speed relative to the first felt, tension within the web during transfer between the first and the second felts is maintained.

Another object of the present invention is the provision of a transfer apparatus which includes a blow box disposed between the first felt roll and the downstream dryer for generating an upstream flow of air for drawing the web into close conformity with the second felt when the first felt diverges relative to the second felt. The blow box also prevents air from entering between an upstream orifice of the blow box and the first felt roll in a direction from the second felt roll which would otherwise tend to cause a tail of the web to follow the first felt.

Another object of the present invention is the provision of a transfer apparatus which includes a blow box having a downstream orifice such that during threading of the dryer section, a tail of the web is positively held in close conformity with the second felt until the tail is disposed between the downstream dryer and the second felt.

Another object of the present invention is the provision of a transfer apparatus including a blow box having openings along the edges thereof so that during use of the apparatus, air flows through the openings for drawing the first and the second edges respectively into close conformity with the second felt so that edge flutter of the web relative to the second felt is inhibited.

Another object of the present invention is the provision of a transfer apparatus including a vacuum box for drawing the web into close conformity with the second felt when the firs felt diverges relative to the second felt and for preventing air from entering between an upstream slot and the first felt roll in a direction from the second felt roll.

Another object of the present invention is the provision of a transfer apparatus which includes a plenum for generating a current of air such that the web is drawn into close conformity with the first felt when the first felt diverges relative to the upstream dryer and for diverting a boundary layer of air that follows the upstream dryer.

Another object of the present invention is the provision of a transfer apparatus which includes a plenum for directing a current of air such that during threading of the dryer section, a tail of the web is positively urged into close conformity with the first felt until the tail is sandwiched between the felts during passage through the web transfer section.

Another object of the present invention is the provision of a transfer apparatus in which the transfer means defines a wall which diverges in a direction from the first felt roll towards the downstream dryer so that during movement of the second felt between the first felt roll and the downstream dryer, a vacuum is generated between the wall and the second felt for drawing the web into close conformity with the second felt.

Another object of the present invention is the provision of a transfer apparatus in which the plenum includes a surface which is disposed on the opposite side of the first felt relative to the second felt roll for generating a partial vacuum between the surface and the first felt for urging the web into close conformity with the first felt between the upstream dryer and the second felt roll.

Other objects and advantages of the present invention will be apparent to those skilled in the art by a consideration o the detailed description contained hereinafter taken in conjunction with the annexed drawings.

SUMMARY OF THE INVENTION

The present invention relates to an apparatus and method for transferring a web from an upstream dryer to a downstream dryer of a dryer section. The apparatus includes a first dryer felt which extends around the upstream dryer for supporting the web such that the web is disposed between the first felt and the upstream dryer for drying a first side of the web. A first felt roll is disposed downstream relative to the upstream dryer for guiding the first felt such that the first felt diverges relative to the upstream dryer and extends from the upstream dryer to and around the first felt roll. A second felt roll is disposed between the upstream dryer and the first felt roll such that the web is disposed between the second felt roll and the first felt. A second dryer felt extends around the downstream dryer for supporting the web such that the web is disposed between the second dryer felt and the downstream dryer for drying a second side of the web. The second felt passes around the second felt roll and extends from the second felt roll to and around the downstream dryer such that the first and second felts define therebetween a web transfer section. The arrangement is such that the web is sandwiched between the first and the second felts between the second and first felt rolls. A transfer means positively transfers the web from the first felt to the second felt when the first felt diverges relative to the second felt.

In a more specific embodiment of the present invention, the first and the second felt rolls and the upstream and downstream dryers are disposed relative to each other such that the web between the upstream and downstream dryers follows a common tangent to the dryers and felt rolls.

In an alternative embodiment of the present invention, the first and the second felt rolls intersect a common tangent of the upstream and downstream dryers such that the first felt wraps around a portion of the second felt roll and the second felt wraps around a portion of the first felt roll so that the felts extending between the second and first felt rolls are disposed parallel relative to each other for stabilizing the felt during transit through the transfer section.

In another embodiment of the present invention, the second felt roll is spaced relative to a common tangent of the upstream and downstream dryers and the first felt roll intersects the tangent such that the felts define therebetween a converging nip such that when the second felt is driven at a higher speed than the first felt, tension within the web during transfer between the first and the second felts is maintained.

In yet another embodiment of the present invention, the felt rolls are spaced relative to a common tangent of the upstream and downstream dryers such that a gap is defined between the felts permitting the second felt to be moved at a higher speed relative to the speed of the first felt, thereby permitting transfer of the web from the first to the second felt while maintaining the web under tension.

More specifically, the transfer means includes a blow box disposed between the first felt roll and the downstream dryer, the blow box being disposed on the opposite side of the second felt relative to the first felt roll such that the second felt is disposed between the web and the blow box. Furthermore, the blow box defines a cross-machine directional upstream orifice for generating an upstream flow of air for drawing the web into close conformity with the second felt when the first felt diverges relative to the second felt.

Additionally, the blow box defines a cross-machine directional downstream orifice which is disposed adjacent to and on the opposite side of the second felt relative to an in-going nip defined between the second felt and the downstream dryer such that during threading of the dryer section, a tail of the web is positively held in close conformity with the second felt until the tail is disposed between the downstream dryer and the second felt.

Also, the blow box defines a first and second opening which extend between the first felt roll and the downstream dryer. The first and second openings are disposed respectively adjacent to the edges of the web so that during use of the apparatus, air flows through the first and second openings for drawing the first and second edges respectively into close conformity with the second felt so that edge flutter of the web relative to the second felt is inhibited.

In an alternative embodiment of the present invention, the transfer means includes a vacuum box which is disposed between the first felt roll and the downstream dryer. The vacuum box defines an upstream slot which extends in a cross-machine direction for drawing the web into close conformity with the second felt when the first felt diverges relative to the second felt and for preventing air from entering between the upstream slot and the first felt roll in a direction from the second felt roll.

The transfer apparatus also includes further means disposed between the upstream dryer and the second felt roll for urging the web away from the upstream dryer and into close conformity with the first dryer felt between the upstream dryer and the second felt roll.

More particularly, the further means includes a plenum which defines a cross-machine directional upstream nozzle disposed adjacent to and on the opposite side of the first felt relative to a divergent nip defined between the upstream dryer and the first felt. The upstream nozzle generates a current of air such that the web is drawn into close conformity with the first felt when the first felt diverges relative to the upstream dryer. Furthermore, the current of air diverts a boundary layer of air which follows the upstream dryer.

Additionally, the plenum further includes a cross-machine directional downstream nozzle which is disposed adjacent to and on the opposite side of the first felt relative to a convergent nip defined between the second felt roll and the first felt. The downstream nozzle directs a current of air such that during threading of the dryer section, a tail of the web is positively urged into close conformity with the first felt until the tail is sandwiched between the felts during passage through the web transfer section.

The transfer means also defines a wall which diverges in a direction from the first felt roll towards the downstream dryer so that during movement of the second felt between the first felt roll and the downstream dryer, a partial vacuum is generated between the wall and the second felt for drawing the web into close conformity with the second felt.

The further means also includes a surface which is disposed on the opposite side of the first felt relative to the second felt. The surface extends between the upstream dryer and the second felt roll. The surface diverges from the first felt in a direction from the upstream dryer towards the second felt roll for generating a partial vacuum between the surface and the first felt for urging the web into close conformity with the first felt between the upstream dryer and the second felt roll.

The present invention also includes a method for transferring a web from an upstream dryer to a downstream dryer of a dryer section, the method comprising the steps of:

extending a first dryer felt around the upstream dryer for supporting the web such that the web is disposed between the first felt and the upstream dryer for drying a first side of the web;

guiding the first felt around a first felt roll disposed downstream relative to the upstream dryer such that the first felt diverges relative to the upstream dryer and extends from the upstream dryer to and around the first felt roll;

supporting the web such that the web is disposed between a second felt and the downstream dryer for drying a second side of the web;

guiding the second felt around a second felt roll disposed between the upstream dryer and the first felt roll such that the web is disposed between the second felt roll and the first felt;

passing the second felt around the second felt roll so that the second felt extends from the second felt roll to and around the downstream dryer such that the first and second felts defines therebetween a web transfer section, the web being sandwiched between the first and second felts between the second and the first felt rolls; and positively transferring the web from the first felt to the second felt when the first felt diverges relative to the second felt.

Many modifications and variations of the present invention will be readily apparent to those skilled in the art by a consideration of the detailed description contained hereinafter taken in conjunction with the annexed drawings. However, the present invention is not limited to the particular embodiments shown in the detailed description and such modifications and variations which are not specifically described fall within the spirit and scope of the present invention as defined by the appended claims.

Included amongst such modifications would be the provision of means for positively transferring the web from the first to the second felt when the first felt diverges relative to the second felt. Such means could include merely a diverging wall for generating, in use of the apparatus, sufficient vacuum to cause a tail of the web to follow the second felt rather than following the first felt.

BRIEF DESCRIPTION OF THE DRAWINGS

FIG. 7 is an enlarged perspective view of the blow box shown in FIG. 3 showing the blow box defining a first and second opening adjacent the edges of the web;

FIG. 8 is a view similar to that shown in FIG. 3 but shows an alternative embodiment of the present invention in which the transfer means includes a vacuum box.

Similar reference characters refer tó similar parts throughout the various embodiments of the present invention.

DETAILED DESCRIPTION OF THE DRAWINGS

Figure 1:
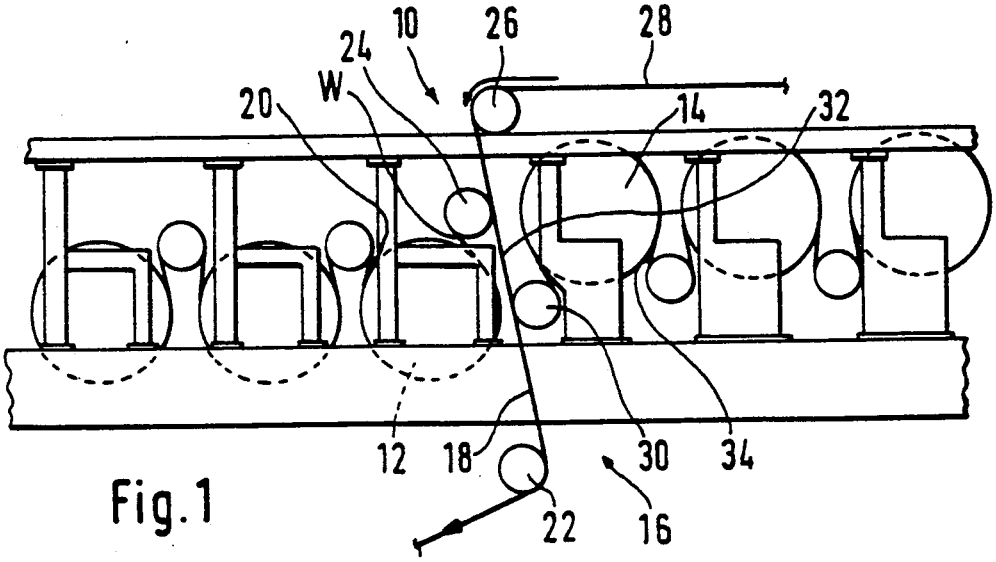
FIG. 1 is a side-elevational view of the TOTAL BELRUN transfer apparatus as described in U.S. patent application Ser. No. 07/014,569.

FIG. 1 is a side-elevational view of a TOTAL BELRUN transfer apparatus as described in co-pending U.S. Ser. No. 07/014,569. The transfer apparatus generally designated 10 transfers a web W from an upstream dryer 12 to a downstream dryer 14 of a dryer section generally designated 16. The apparatus 10 includes a first dryer felt 18 extending around the upstream dryer 12 for supporting the web W such that the web W is disposed between the first felt 18 and the upstream dryer 12 for drying a first side 20 of the web W.

A first felt roll 22 is disposed downstream relative to a transfer vacuum roll 24 such that the first felt 18 is guided from the dryer 12 around the vacuum transfer roll 24 to and around the felt roll 22. A second felt roll 26 guides a second felt 28 towards and around a further transfer vacuum guide roll 30 such that a web transfer section 32 is defined between the felts 18 and 28. As can be seen from FIG. 1, the first side 20 of the web W is dried during passage of the web W past the upstream dryer 12, and a second side 34 of the web W is dried during passage of the web past the downstream dryer 14. Also, the web W is transferred through the web transfer section 32 without open draw, thereby restraining the web W against cross-machine directional shrinkage thereof. However, the aforementioned arrangement requires the provision of a first and second relatively costly vacuum transfer roll 24 and 30 respectively. Also, the web W follows a path other than unidirectional during passage of the web through the transfer apparatus 10.

The present invention, as shown in FIGS. 2 to 9, overcomes the need for the two vacuum transfer rolls 24 and 30 shown in FIG. 1 and provides a unidirectional transfer of the web through a transfer apparatus.

Figure 2:
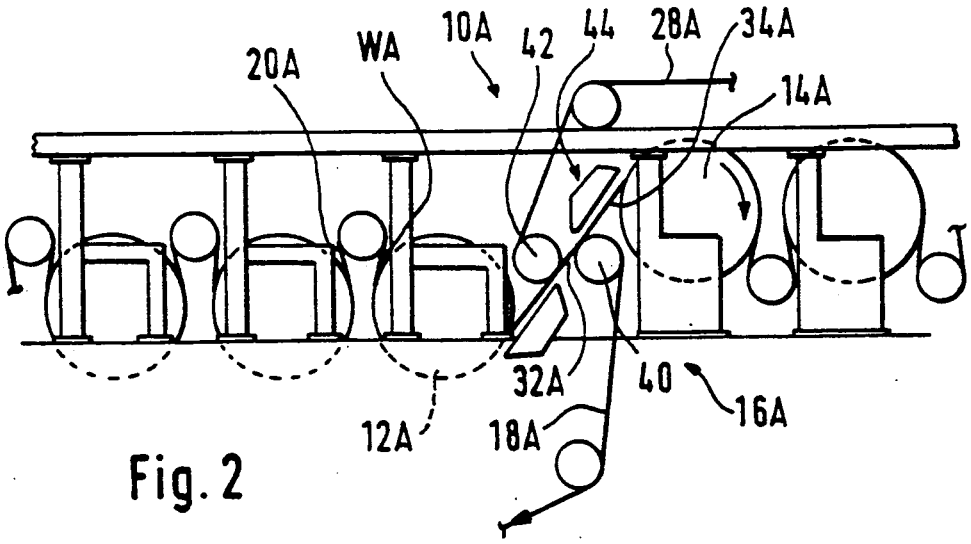
FIG. 2 is a side-elevational view of a transfer apparatus according to the present invention showing a first and second felt roll and means for positively transferring the web from the first felt to the second felt.

More specifically, FIG. 2 is a side-elevational view of a transfer apparatus generally designated 10A according to the present invention. The apparatus 10A transfers a web WA from an upstream dryer 12A to a downstream dryer 14A of a dryer section generally designated 16A. The apparatus 10A includes a first dryer felt 18A which extends around the upstream dryer 12A for supporting the web WA such that the web WA is disposed between the first felt 18A and the upstream dryer 12A for drying a first side 20A of the web WA.

A first felt roll 40 is disposed downstream relative to the upstream dryer 12A for guiding the first felt 18A such that the first felt 18A diverges relative to the upstream dryer 12A and extends from the upstream dryer 12A to and around the first felt roll 40.

A second felt roll 42 is disposed between the upstream dryer 12A and the first felt roll 40 such that the web WA is disposed between the second felt roll 42 and the first felt 18A.

A second dryer felt 28A extends around the downstream dryer 14A for supporting the web WA such that the web WA is disposed between the second dryer felt 28A and the downstream dryer 14A for drying a second side 34A of the web WA.

The second felt 28A passes around the second felt roll 42 and extends from the second felt roll 42 to and around the downstream dryer 14A such that the first and second felts 18A and 28A respectively define therebetween a web transfer section 32A. The web WA is therefore sandwiched between the first and second felts 18A and 28A respectively between the second and first felt rolls 42 and 40 respectively. Means generally designated 44 are provided for positively transferring the web WA from the first felt 18A to the second felt 28A when the first felt 18A diverges relative to the second felt 28A.

Figure 3:
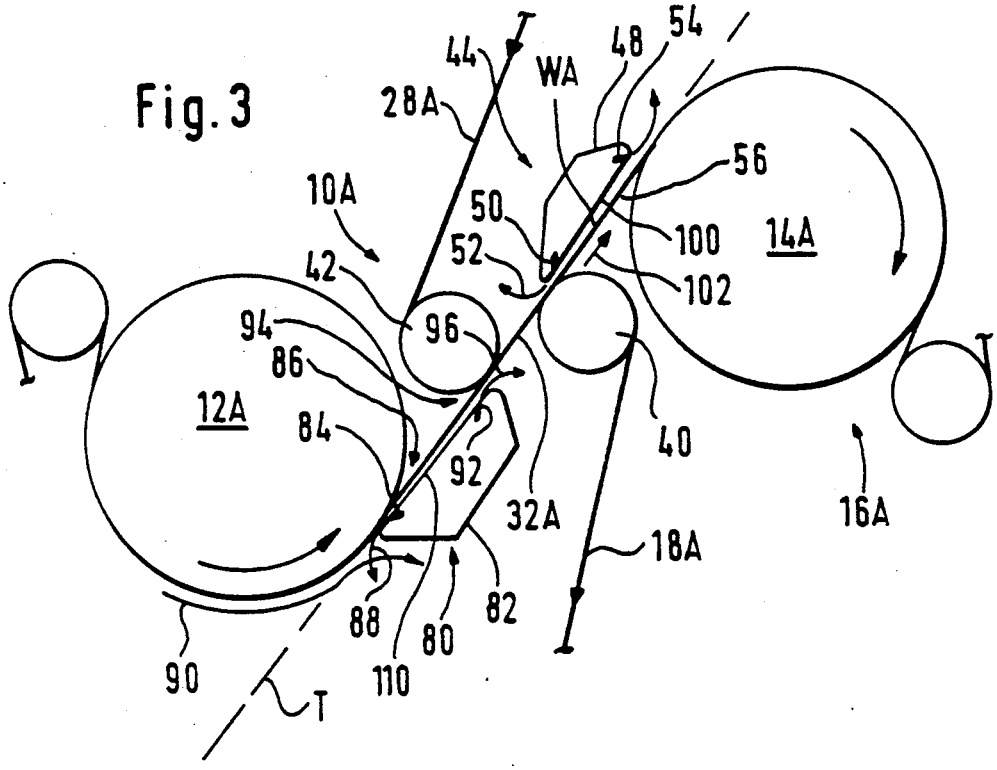
FIG. 3 is an enlarged side-elevational view of the transfer apparatus shown in FIG. 2 showing the felt rolls and the dryers disposed relative to each other such that the web follows a common tangent to the dryers and the felt rolls.

FIG. 3 is an enlarged side-elevational view of the transfer apparatus 10A shown in FIG. 2 and shows the first and second felt rolls 40 and 42 respectively. Also, the upstream and downstream dryers 12A and 14A respectively are disposed relative to each other such that the web WA between the upstream and downstream dryers 12A and 14A follow a common tangent T to the dryers 12A and 14A and the felt rolls 40 and 42 respectively.

Figure 4:
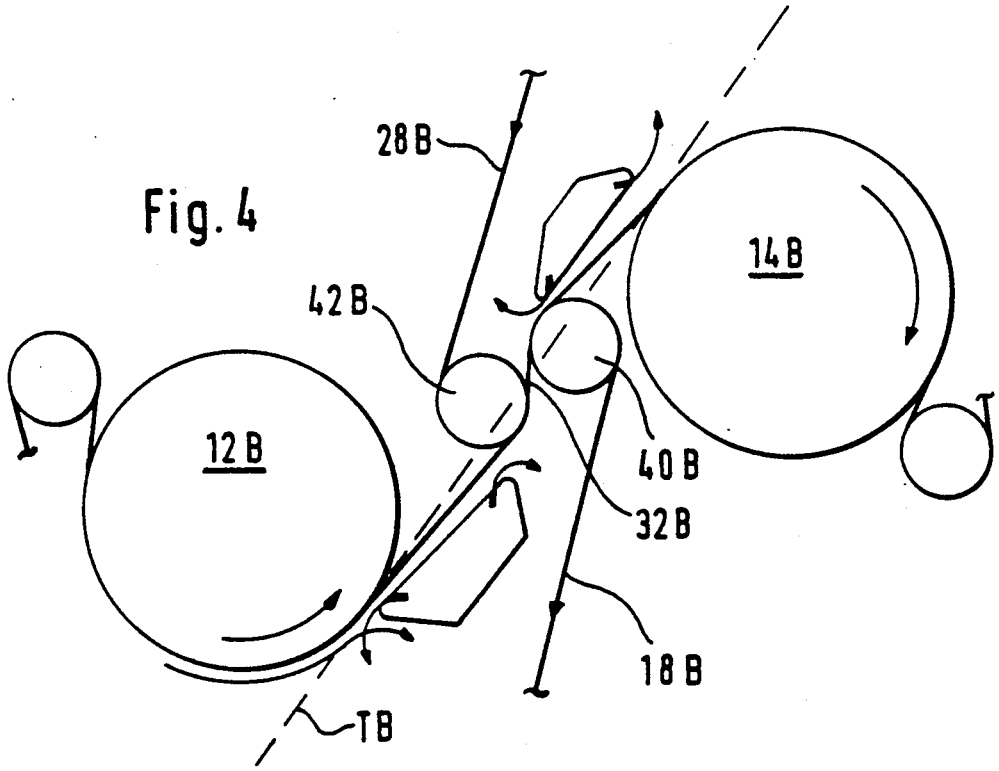
FIG. 4 is a similar view to that shown in FIG. 3 but shows another embodiment of the present invention in which the first felt wraps the second felt roll and the second felt wraps the first felt roll for stabilizing the felt during transit through the transfer section.

FIG. 4 is a similar view to that shown in FIG. 3 but shows an alternative embodiment of the present invention in which a first and a second felt roll 40B and 42B respectively intersect a common tangent TB of an upstream and a downstream dryer 12B and 14B respectively such that a first felt 18B wraps around the second felt roll 42B and a second felt 28B wraps around the first felt roll 40B so that the felts 18B and 28B extend between the second and first felt rolls 42B and 40B respectively to define a web transfer section 32B. The felts 18B and 28B are disposed parallel relative to each other during passage through the transfer section 32B for stabilizing the felts 18B and 28B during transit through the transfer section 32B.

Figure 5:
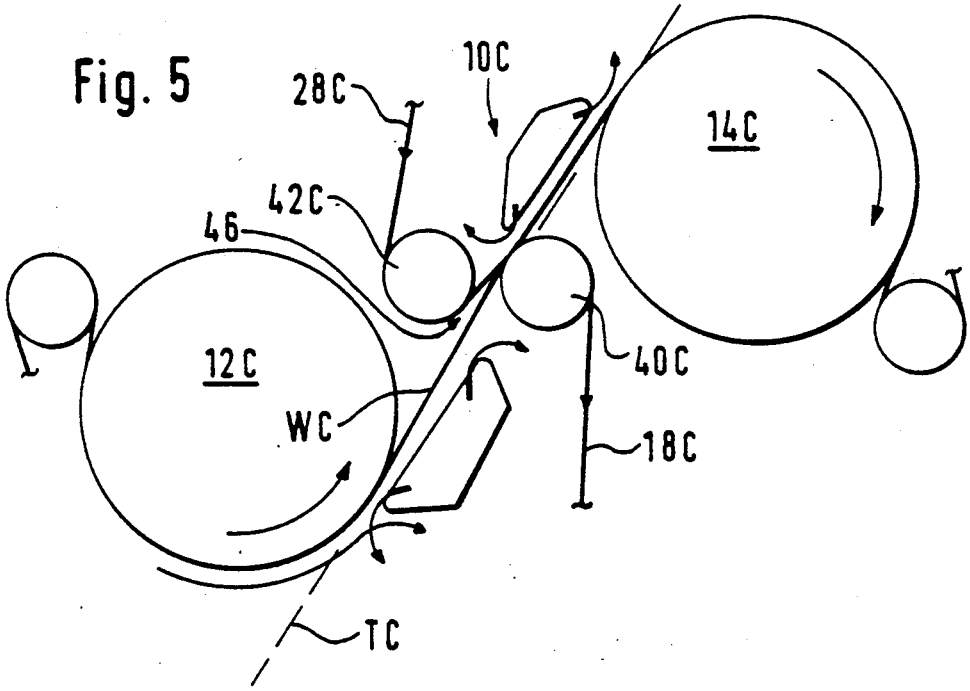
FIG. 5 is a similar view to that shown in FIG. 3 but shows a further embodiment of the present invention in which the second felt roll is spaced relative to a common tangent of the upstream and downstream dryers so that when the second felt is driven at a higher speed than the first felt, tension within the web during transfer between the first and second felts is maintained.

FIG. 5 is a similar view to that shown in FIG. 3 but shows a further embodiment of the present invention in which a second felt roll 42C is spaced relative to a common tangent TC of an upstream and a downstream dryer 12C and 14C. A first felt roll 40C intersects the tangent TC such that a first and second felt 18C and 28C define therebetween a converging nip 46. The arrangement is such that when the second felt 28C is driven at a higher speed than the first felt 18C, tension within the web WC during transfer between the first and second felts 18C and 28C is maintained.

Figure 6:
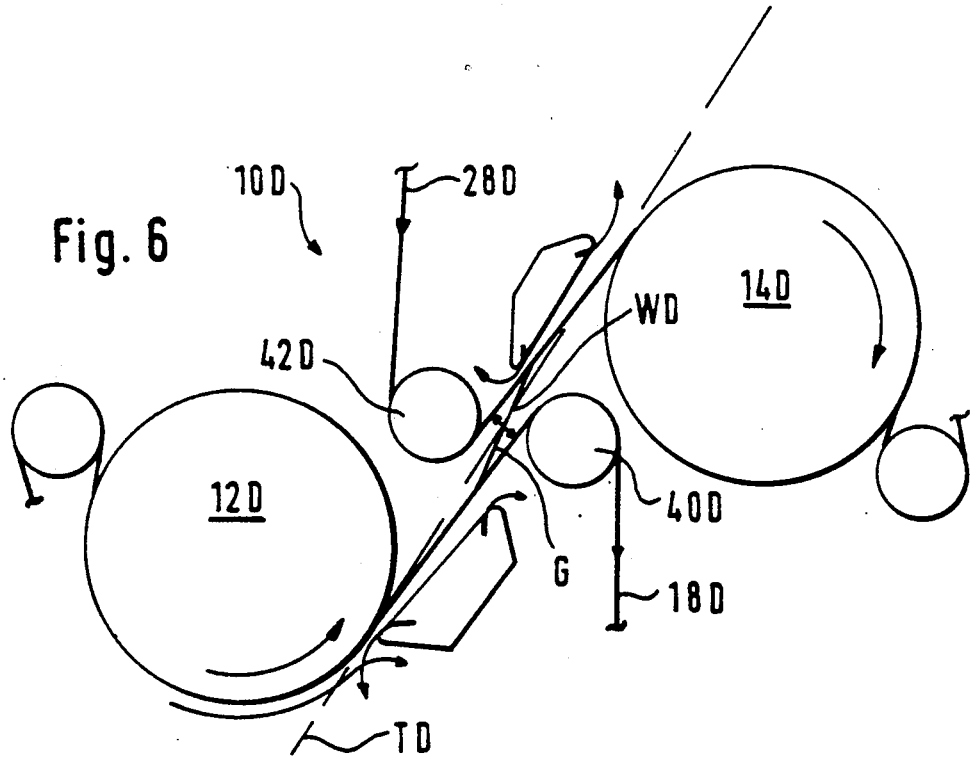
FIG. 6 is a similar view to that shown in FIG. 3 but shows a further embodiment of the present invention in which the felt rolls are spaced relative to a common tangent of the dryers thereby permitting transfer of the web from the first to the second felt while maintaining the web under tension.

FIG. 6 is a similar view to that shown in FIG. 3 but shows yet another embodiment of the present invention in which a transfer apparatus 10D includes a first and second felt roll 40D and 42D respectively. The felt rolls 40D and 42D are spaced relative to a common tangent TD of an upstream and a downstream dryer 12D and 14D such that a gap, as indicated by the arrow G, is defined between a first and second felt 18D and 28D. Such gap G permits the second felt 28D to be moved at a higher speed relative to the speed of the first felt 18D, thereby permitting transfer of a web WD from the first felt 18D to the second felt 28D while maintaining the web WD under tension.

As shown in FIG. 3, the means generally designated 44 includes a blow box 48 disposed between the first felt roll 40 and the downstream dryer 14A. The blow box 48 is disposed on the opposite side of the second felt 28A relative to the first felt roll 40 such that the second felt 28A is disposed between the web WA and the blow box 48. The blow box 48 defines a cross-machine directional upstream orifice 50 for generating an upstream flow of air, as indicated by the arrow 52, for drawing the web WA into close conformity with the second felt 28A when the first felt 18A diverges relative to the second felt 28A. The flow of air 52 also prevents air from entering between the upstream orifice 50 and the first felt roll 40 in a direction from the second felt roll 42.

Also, as shown in FIG. 3, the blow box 48 defines a cross-machine directional downstream orifice 54 which is disposed adjacent to and on the opposite side of the second felt 28A relative to an in-going nip 56 defined between the second felt 28A and the downstream dryer 14A. The arrangement is such that during threading of the dryer section 16A, a tail of the web WA is positively held in close conformity with the second felt 28A until the tail is disposed between the downstream dryer 14A and the second felt 28A.

FIG. 7 is a fragmentary perspective view of the blow box 48 as shown in FIG. 3 and shows the blow box 48 defining a first and second opening 58 and 60 which extend between the first felt roll 40 and the downstream dryer 14A. The felt roll 40 and the dryer 14A are not shown in FIG. 7 for clarity. The first and second openings 58 and 60 are disposed respectively adjacent to the edges 62 and 64 of the web WA so that during use of the apparatus 10A, air flows, as indicated by the arrows 66 and 68, through the first and second openings 58 and 60 for drawing the first and second edges 62 and 64 respectively into close conformity with the second felt 28A so that edge flutter of the web WA relative to the second felt 28A is inhibited.

In an alternative embodiment of the present invention as shown in FIG. 8, the means 44E includes a vacuum box 70 which is disposed between a first felt roll 40E and a downstream dryer 14E. The vacuum box 70 defines an upstream slot 72 which extends in a cross-machine direction such that when the vacuum box 70 is connected to a source of partial vacuum 74, a web WE is drawn into close conformity with a second felt 28E when a first felt 18E diverges relative to the second felt 28E.

The transfer apparatus 10A, shown in FIG. 3, also includes further means generally designated 80. The further means 80 is disposed between the upstream dryer 12A and the second felt roll 42 for urging the web WA away from the upstream dryer 12A and into close conformity with the first dryer felt 18A between the upstream dryer 12A and the second felt roll 42.

More specifically, the further means 80 includes a plenum 82 defining a cross-machine directional upstream nozzle 84 disposed adjacent to and on the opposite side of the first felt 18A relative to a divergent nip 86 defined between the upstream dryer 12A and the first felt 18A. The upstream nozzle 84 generates a current of air indicated by the arrow 88 such that the web WA is drawn into close conformity with the first felt 18A when the first felt 18A diverges relative to the upstream dryer 12A. The current of air 88 also diverts a boundary layer of air, as indicated by the arrow 90, which follows the upstream dryer 12A.

More specifically, the plenum 82 further includes a cross-machine directional downstream nozzle 92 disposed adjacent to and on the opposite side of the first felt 18A relative to a convergent nip 94 defined between the second felt roll 42 and the first felt 18A. The downstream nozzle 92 directs a current of air, indicated by the arrow 96, such that during threading of the dryer section 16A, a tail of the web WA is positively urged into close conformity with the first felt 18A until the tail is sandwiched between the felts 18A and 28A during passage through the web transfer section 32A.

As shown in FIG. 3, the means 44 defines a wall 100 which diverges in a direction, as indicated by the arrow 102, from the first felt roll 40 towards the downstream dryer 14A so that during movement of the second felt 28A between the first felt roll 40 and the downstream dryer 14A, a vacuum is generated between the wall 100 and the second felt 28A for drawing the web WA into close conformity with the second felt 28A.

Also, as shown in FIG. 3, the further means 80 includes a surface 110 disposed on the opposite side of the firs felt 18A relative to the second felt roll 42. The surface 110 extends between the upstream dryer 12A and the second felt roll 42. The surface 110 diverges from the first felt 18A in a direction, as indicated by the arrow 102, from the upstream dryer 12A towards the second felt roll 42 for generating a partial vacuum between the surface 110 and the first felt 18A for urging the web WA into close conformity with the first felt 18A between the upstream dryer 12A and the second felt roll 42.

Figure 9:
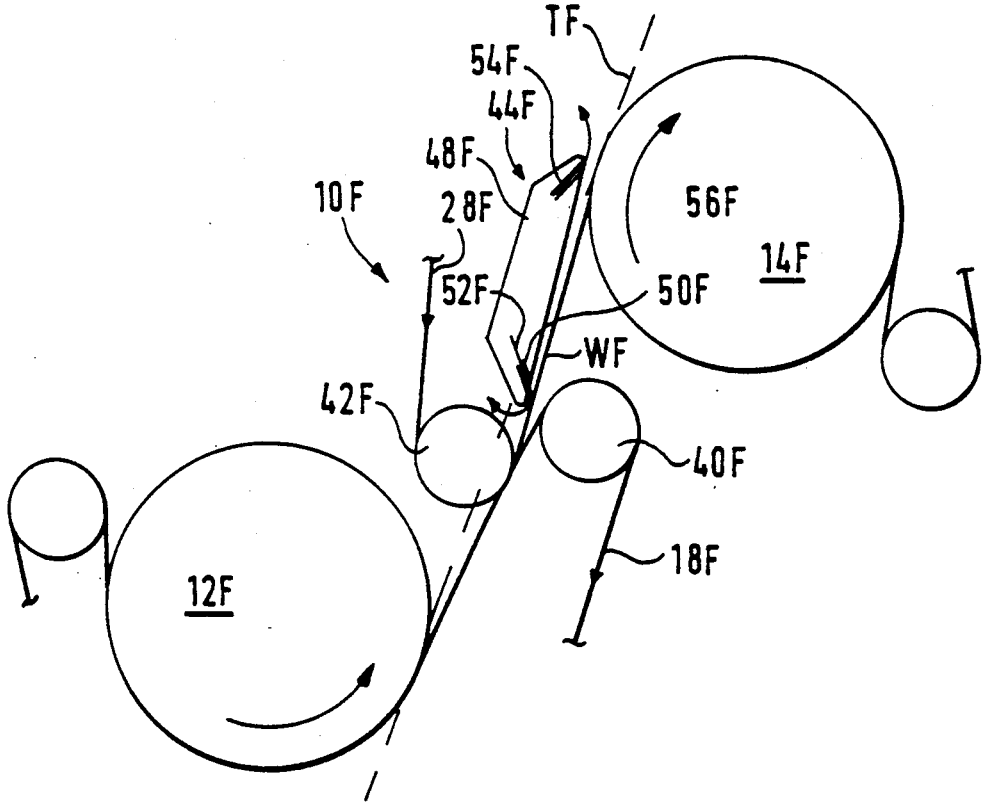
FIG. 9 is a view similar to that shown in FIG. 3 but shows an alternative embodiment of the present invention in which the second felt roll intersects a common tangent of the dryers.

FIG. 9 is a side-elevational view of yet another embodiment of the present invention and includes a transfer apparatus generally designated 10F. The apparatus 10F includes a first and second felt roll 40F and 42F respectively. The felt roll 40F is spaced relative to a common tangent TF of an upstream and downstream dryer 12F and 14F respectively. The second felt roll 42F intersects the common tangent TF so that a first felt 18F extending around dryer 12F extends around a portion of the roll 40F so that the web WF is sandwiched between the first felt 18F and a second felt 28F extending around felt roll 42F and the dryer 14F.

As shown in FIG. 9, means generally designated 44F includes a blow box 48F disposed between the first felt roll 40F and the downstream dryer 14F. The blow box 48F is disposed on the opposite side of the second felt 28F relative to the first felt roll 40F such that the second felt 28F is disposed between the web WF and the blow box 48F. The blow box 48F defines a cross-machine directional upstream orifice 50F for generating an upstream flow of air as indicated by the arrow 52F for drawing the web WF into close conformity with the second felt 28F when the first felt 18F diverges relative to the second felt 28F. The flow of air 52F also prevents air from entering between the upstream orifice 50F and the first felt roll 40F in a direction from the second felt roll 42F which would tend to detach a tail of the web from the second felt 28F.

Also, as shown in FIG. 9, the blow box 48F defines a cross-machine directional downstream orifice 54F which is disposed adjacent to and on the opposite side of the second felt 28F relative to an in-going nip 56F defined between the second felt 28F and the downstream dryer 14F. The arrangement is such that during threading of the dryer section, a tail of the web WF is positively held in close conformity with the second felt 28F from the second felt roll 42F until the tail is disposed between the downstream dryer 14F and the second felt 28F.

It will be understood by those in the art that a vacuum box can be used in place of the blow box 48F and a vacuum or blow box similar to the means 80 shown in FIG. 3 can be disposed between the dryer 12F and the second felt roll 42F.

In operation of the transfer apparatus 10A, air is supplied to the blow box 48 and to the plenum 82 so that when the transfer apparatus is to be threaded, a tail of the web WA is drawn towards felt 18A as felt 18A diverges relative to the upstream dryer 12A. The tail automatically threads through converging nip 94 because the positive pressure at converging nip 94 is reduced by the flow of air 96. The tail progresses through the web transfer section 32A and follows the second felt 28A rather than the first felt 18A due to the air current 52 which draws the tail towards the second felt 28A. Similarly, the positive air pressure nip 56 is compensated for by the provision of the orifice 54 so that the tail readily threads between the second felt 28A and the downstream dryer 14A.

The diverging surface 110 and the diverging wall 100 augment the flows of air generated by the plenum and blow box respectively.

The arrangement shown in FIG. 4 is similar in operation to that shown in FIG. 3 except in that the web transfer section 32B enables a more positive stabilization of the respective dryer felts.

FIG. 5 provides an in-going nip 46 between the felts 18C and 28C so that when the felt 28C moves at a slightly higher speed than the felt 18C, the web WC is maintained in tension.

FIG. 6 shows a gap G between the felts 18D and 28D. Such gap G is very small in practice but is shown in FIG. 6 as a relatively large gap for clarity. The web WD is positively transferred from the felt 18D due to an upstream flow of air from the adjacent blow box so that the web WD is positively drawn towards the felt 28D when the felt 18D diverges relative to the second felt 28D.

The openings 58 and 60 generate air flows which draw the edges 62 and 64 of the web into close conformity with the supporting felt 28A.

In operation of the arrangement shown in FIG. 8, the blow box and plenum are replaced by vacuum boxes for positively drawing the tail of the web into conformity with the first felt 18E and then towards the second felt 28E when the first felt diverges relative to the second felt 28E.

The present invention provides a transfer apparatus that does not require relatively costly vacuum transfer rolls. Furthermore, the present invention provides a unidirectional transfer of the web from an upstream to a downstream dryer for drying alternate sides of the web.

What is claimed is:

1. A transfer apparatus for transferring a web from an upstream dryer to a downstream dryer of a dryer section, said apparatus comprising:

a first dryer felt extending around the upstream dryer for supporting the web such that the web is disposed between said first felt and the upstream dryer for drying a first side of the web;

a first felt roll disposed downstream relative to the upstream dryer for guiding said first felt such that said first felt diverges relative to the upstream dryer and extends from the upstream dryer to and around said first felt roll;

a second felt roll disposed between the upstream dryer and said first felt roll such that the web is disposed between said second felt roll and said first felt;

a second dryer felt extending around the downstream dryer for supporting the web such that the web is disposed between said second dryer felt and the downstream dryer for drying a second side of the web;

said second felt passing around said second felt roll and extending from said second felt roll to and around the downstream dryer such that said first and second felts define therebetween a web transfer section, the web being sandwiched between said first and second felts between said second and first felt rolls;

means for positively transferring the web from said first felt to said second felt when said first felt diverges relative to said second felt;

said means includes:

a blow box disposed between said first felt roll and said downstream dryer, said blow box being disposed on the opposite side of said second felt relative to said first felt roll such that said second felt is disposed between the web and said blow box, said blow box defining a cross-machine directional, upstream orifice for generating an upstream flow of air for drawing the web into close conformity with said second felt when said first felt diverges relative to said second felt and for preventing air from entering between said upstream orifice and said first felt roll in a direction from said second felt roll; and said blow box defining a first and second opening extending between said first felt roll and the downstream dryer, said first and second openings being disposed respectively adjacent to the edges of the web so that during use of said apparatus, air flows through said first and second openings for drawing said first and second edges respectively into close conformity with said second felt so that edge flutter of the web relative to said second felt is inhibited.

2. A transfer apparatus as set forth in claim 1 wherein said first and second felt rolls and the upstream and downstream dryers are disposed relative to each other such that the web between the upstream and downstream dryers follows a common tangent to the dryers and felt rolls.

3. A transfer apparatus as set forth in claim 1 wherein said first and second felt rolls intersect a common tangent of the upstream and downstream dryers such that said first felt wraps around said second felt roll and said second felt wraps around said first felt roll so that said felts extending between said second and first felt rolls are disposed parallel relative to each other for stabilizing said felts during transit through said transfer section.

4. A transfer apparatus as set forth in claim 1 wherein said second felt roll is spaced relative to a common tangent of the upstream and downstream dryers, said first felt roll intersecting said tangent such that said felts define therebetween a converging nip.

5. A transfer apparatus as set forth in claim 1 wherein said second felt roll intersects a common tangent of the upstream and downstream dryers, said first felt roll being spaced relative to said common tangent such that the web is sandwiched between said first and second felts adjacent to said second felt roll.

6. A transfer apparatus as set forth in claim 1 wherein said felt rolls are spaced relative to a common tangent of the upstream and downstream dryers such that a gap is defined between said felts permitting said second felt to be moved at a higher speed relative to the speed of said first felt permitting transfer of the web from said first to said second felt while maintaining the web under tension.

* * * * *

UNITED STATES PATENT AND TRADEMARK OFFICE

CERTIFICATE OF CORRECTION

PATENT NO. : 5,101,577

DATED : April 7, 1992

INVENTOR(S) : Gregory L. Wedel

It is certified that error appears in the above—identified patent and that said Letters Patent is hereby corrected as shown below:

On the Title page, Column 2, Line 1: Please delete "Drik" and insert --Dirk-- in place thereof.

Column 3, Line 18: Please delete "firs" and insert --first-- in place thereof.

Column 3, Line 54: Please delete "o" and insert --of-- in place thereof.

Column 10, Line 22: Please delete "firs" and insert --first--in place thereof.

Signed and Sealed this

Eighth Day of June, 1993

*Attest:*

Michael K. Kirk

MICHAEL K. KIRK

*Attesting Officer*

*Acting Commissioner of Patents and Trademarks*